United States Patent [19]

Stephens

[11] 4,385,783

[45] May 31, 1983

[54] UPHOLSTERED FURNITURE ELEMENT

[75] Inventor: William I. Stephens, Emmaus, Pa.

[73] Assignee: Knoll International, Inc., New York, N.Y.

[21] Appl. No.: 38,123

[22] Filed: May 11, 1979

[51] Int. Cl.[3] ..... A47C 7/00

[52] U.S. Cl. ..... 297/455; 297/218; 297/353; 297/422; 297/410

[58] Field of Search ..... 297/218–220, 297/223, 227, 231, 283, 391, 397, 410, 452, 411, 416, 422, 454–456

[56] References Cited

U.S. PATENT DOCUMENTS

| | | | |
|---|---|---|---|
| 2,837,144 | 6/1958 | Heller | 297/456 X |
| 3,680,916 | 8/1972 | Gilbert et al. | 297/219 X |
| 3,995,893 | 12/1976 | Delataille et al. | 297/452 |

FOREIGN PATENT DOCUMENTS

| | | | |
|---|---|---|---|
| 2405774 | 8/1974 | Fed. Rep. of Germany | 297/391 |
| 2324436 | 12/1974 | Fed. Rep. of Germany | 297/422 |
| 2262643 | 9/1975 | France | 297/455 |

*Primary Examiner*—Francis K. Zugel
*Attorney, Agent, or Firm*—Robert Scobey

[57] ABSTRACT

A furniture element for use as a seating unit or a component thereof (e.g. a chair back, seat, or arm), comprising an upholstered body foldable about at least one axis into overlapping portions with facing inner surfaces. Each portion of the body includes a panel; the body also includes a cushion disposed outwardly of the panels and extending between them, and a flexible web outwardly covering the cushion with margins extending around the edges of the panels and secured in overlying relation to the inner surfaces of the panels. The element additionally includes at least one trim member (such as a welt), secured to the inner surface of one of the panels around the edges thereof with ends curving toward each other at the locality of folding, and means for fastening the folded portions of the body together. Supporting structure may be mounted between the panels, or at an outer surface of the folded body, for interconnecting the furniture element with other elements of a chair or the like.

30 Claims, 20 Drawing Figures

Fig. 4.
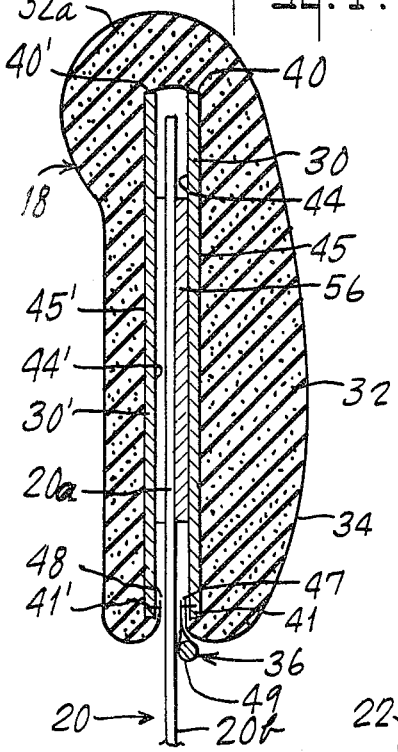
Fig. 8.
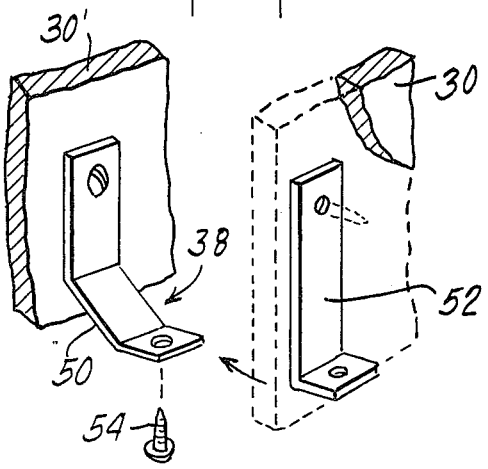
Fig. 5.
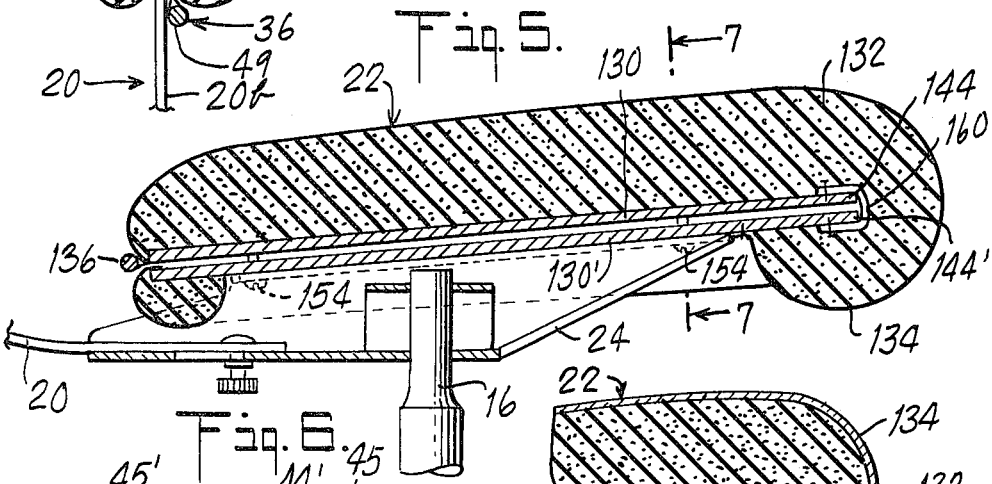
Fig. 6.
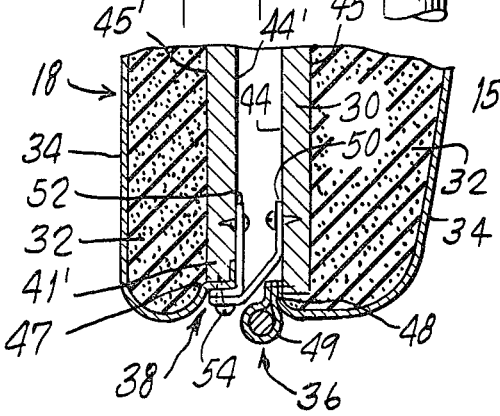
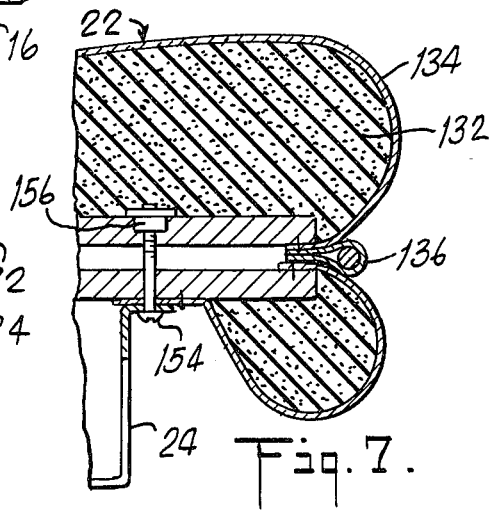
Fig. 7.

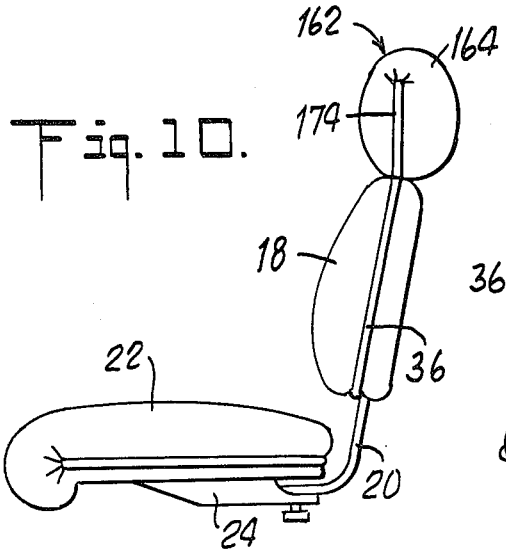
Fig. 10.
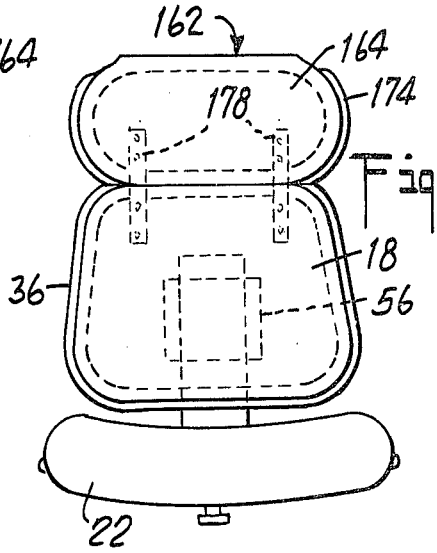
Fig. 11.
Fig. 12.
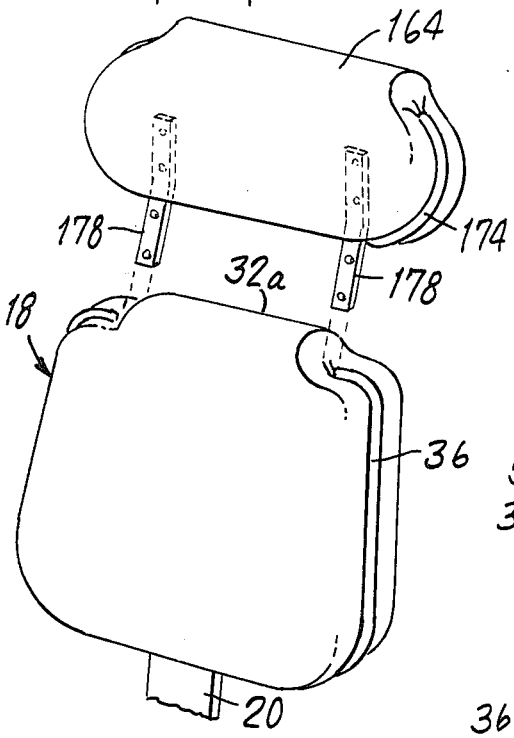
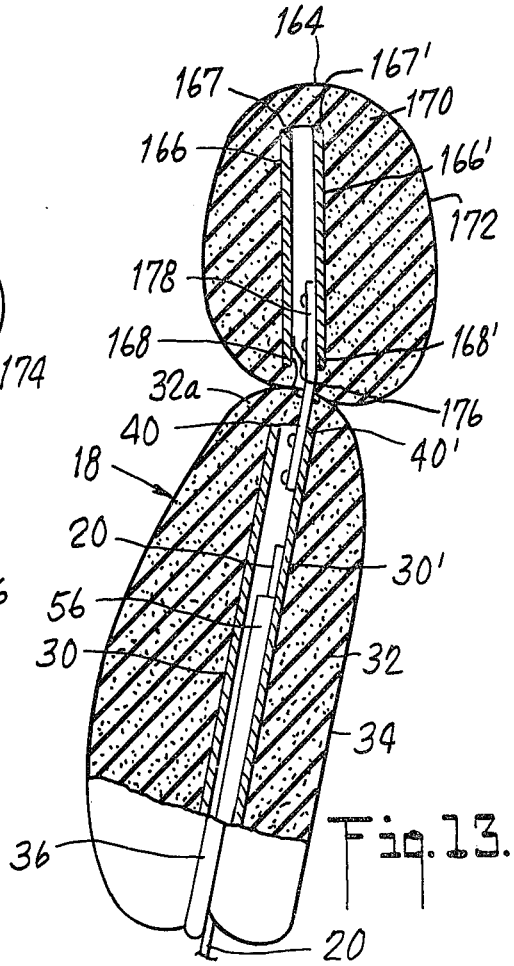
Fig. 13.

Fig.14.
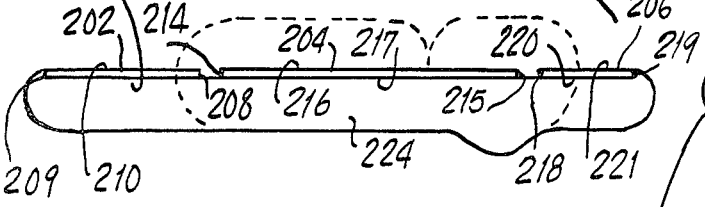
Fig.15.
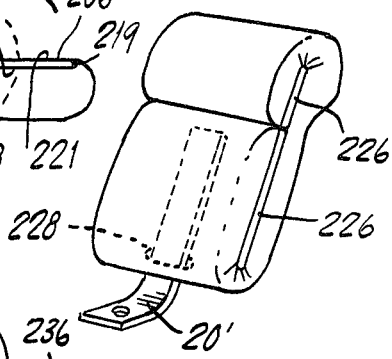
Fig.16.
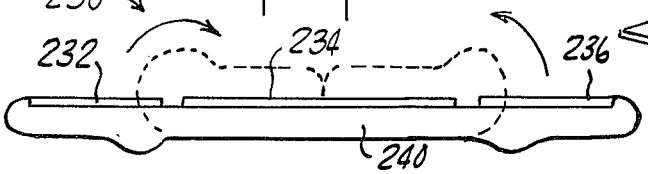
Fig.17.
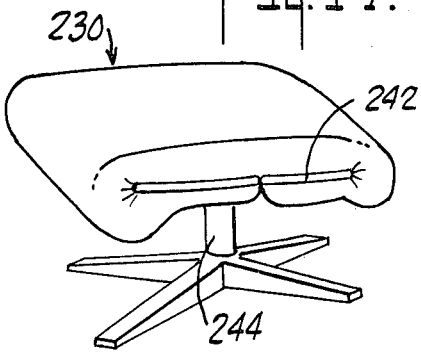
Fig.18.
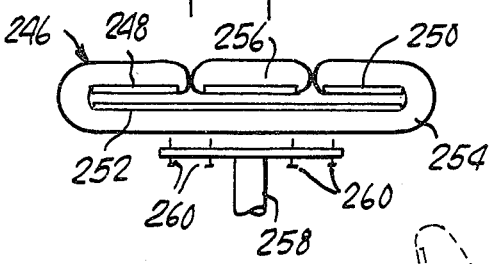
Fig.19.
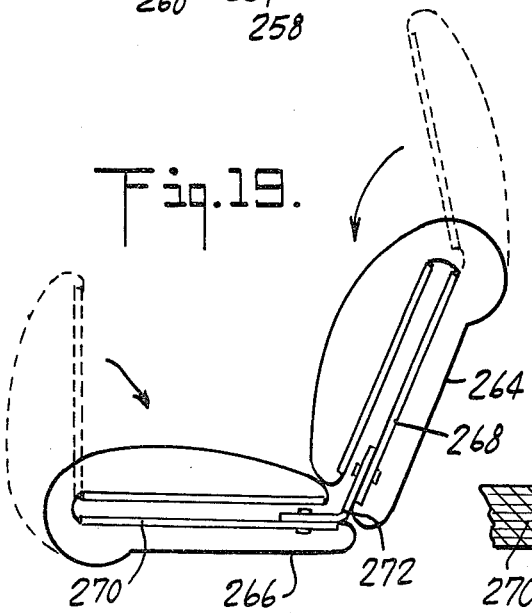
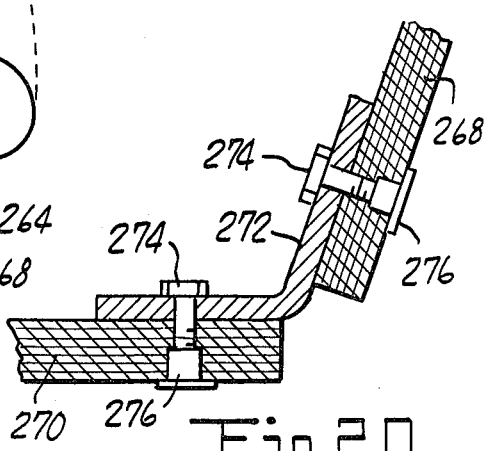
Fig.20.

UPHOLSTERED FURNITURE ELEMENT

BACKGROUND OF THE INVENTION

This invention relates to upholstered furniture elements for use as backs, seats or arms of seating units such as chairs and the like, and to seating units constituted of these elements as well as to methods of making them.

Important specific applications of the invention, to which detailed reference will be made herein for purposes of illustration, reside in the provision of office and home furnishings, such as chairs and other seating units, for example chairs having plural separate upholstered elements (including a back, a seat, and sometimes also arms) which may be adjustable in relative position to suit the user's comfort and are supported together on a pedestal or other base. Typically, each of these elements is self-sustaining in shape, having a rigid internal structure at least partially surrounded by a foam or other cushioning body, and an external covering web of flexible sheet material (e.g. fabric, leather, or vinyl) stretched over the internal structure and the cushion. This cover is customarily joined at a seam extending along or adjacent a peripheral edge of the element, and a bead-shaped welt is commonly formed or provided along the seam for reasons of appearance and/or protection. Frequently, though not always, at least some of the elements of a chair are contoured with complex surface curvature, again for the sake of appearance and also to conform to the user's body. Important or desired attributes of chairs of the described type, and their constituent elements, include aesthetically pleasing design, comfort, durability, and ease of manufacture and repair.

Heretofore, however, the production of such upholstered chair elements has presented problems, owing in particular to the difficulty of properly stretching the cover, forming the seam (e.g by hand sewing the seam closed, or providing a zipper to close it), and forming or attaching the welt around the complex curves of the element surfaces. Like difficulties have been encountered in repairing or reupholstering these elements. The attachment of support members for adjustably interconnecting the chair elements has presented still further complications in manufacture.

SUMMARY OF THE INVENTION

The present invention broadly contemplates the provision of a furniture element foldable about at least one axis into at least two overlapping portions with facing inner surfaces, and means for fastening the overlapped portions together. In accordance with particular features of the invention, each of the overlapping portions includes a panel, and the element further includes a body of upholstery extending over the outer surfaces of both panels and across the axis of folding, the upholstery body having a web margin which extends around edges of the panels and is secured in overlying relation to the panel inner surfaces such that the web margin is concealed when the element is folded, i.e. when the element portions overlap. In accordance with another particular feature of the invention, the element includes at least one trim member such as a welt member mounted at the inner surface of one of the element portions along the edges thereof and projecting laterally beyond the edges so as to be visible when the element is folded, and having ends extending into the locality of folding so as to be concealed when the element is folded. In accordance with a further particular feature of the invention, the fastening means comprises means for detachably fastening the element portions together, e.g. to permit unfolding for repair or reupholstering if necessary.

More particularly, in preferred embodiments the invention contemplates the provision of an upholstered furniture element comprising at least two panels each having edges (including a first end edge) and inner and outer major surfaces, the two panels being disposed with their first end edges in closely adjacent, generally parallel relation for angular movement relative to each other about an axis intermediate and generally parallel to their first end edges between an open position in which their inner surfaces face generally in the same direction and an assembled position in which their inner surfaces are in facing relation to each other; a flexible body of upholstery extending over the outer surfaces of the two panels and bridging their first end edges, this body having a web margin with portions respectively extending around edges of the two panels and secured in overlying relation to the panel inner surfaces so that when the panels are in assembled position the margin of the upholstery is concealed; and means for fastening the two panels together in the assembled position. The upholstery body conveniently or preferably comprises a cushion layer extending over the outer surfaces of the panels and a flexible web cover extending over the cushion layer in outwardly covering relation thereto, with the margin of the cover being the web margin of the upholstery and overlying the panel inner surfaces, e.g. along edges thereof. It will be understood that the terms "inner" and "outer" are used herein to designate directions respectively toward and away from the interior of the element when the element is fully assembled; the term "panel," as used herein, embraces not only a unitary board or the like but also a composite frame structure such as an openwork or skeletal frame made up of interconnected pieces cooperatively providing an internal supporting and/or mounting structure for the upholstery body of the element. Alternatively, the plural "panels" may be plural sections of a unitary board which is sufficiently flexible or bendable to be capable of folding along one or more axes. In presently preferred embodiments, the panels (as just defined) are sufficiently rigid to constitute a shape-sustaining structure for the element.

The panels may be curved to conform to the user's body, and the panel edges may also be curved for aesthetic reasons. Thus, the term "generally parallel" as used herein designates a positional relationship wherein the lines respectively tangent to the midpoints of the first end edges of the panels are parallel to each other and to the axis of angular movement of the panels, i.e. whether or not the first end edges are straight. In addition, the terms "side edges" and "second end edge" embrace edges which are portions of a continuously curved peripheral edge, as well as edges which approximate the sides of a rectangle.

As a particular feature of the invention, in preferred embodiments at least one trim member (e.g. a welt member) is provided for concealing the juncture between panels when the panels are in assembled position, and is secured to the inner surface of one of the panels along edges (other than the first end edge) thereof, projecting laterally beyond the panel so as to be visible when the panels are in the assembled position, with its end or ends extending sufficiently far along the first end edge of that panel so as to be concealed when the panels are in the assembled position. The trim member is preferably a flexible welt member, and as secured to a panel having side edges and a second end edge opposed to the first end edge it extends entirely around the side edges and second end edge with its ends curving toward each other along the first end edge from opposite sides of the panel. Alternatively, a rigid (e.g. metal) trim bead or strip may be used as the trim member. In some cases, where a very full cushion is used, laterally surrounding the panel edges, the fullness of the cushion may adequately conceal the juncture between panels without resort to provision of a trim member.

As a further particular feature of the invention, the fastening means may be means (e.g. externally accessible threaded fasteners) for detachably securing the panels together in the assembled position so that the panels can be re-opened if necessary for repair or reupholstering. Support members for interconnecting the element with other elements of a chair can be mounted between the panels of the element (e.g. where the element is used as a chair back or arm) or on one outer surface of the assembled element; in the latter case, the cushion may have an opening in register with a central portion of this element outer surface to facilitate attachment of the support member thereon.

In preferred configurations, the two panels both have opposed side edges and (at any given distance from their first end edges) are substantially equal to each other in width between the side edges, the side edges of the two panels being in register with each other when the panels are in the assembled position thereby to facilitate concealment of the upholstery web margin and in conjunction with the welt or other trim member to present a pleasing design appearance. For use of the element as a separate back, seat or arm of an office or secretarial chair or the like, it is preferable that the element be constituted of two panels (each having a second end edge opposed to the first end edge thereof) so dimensioned as to be substantially equal to each other in length between the end edges (as well as in width between the two side edges), the panels thus being substantially identical to each other in dimensions and configuration.

Alternatively, the element may include a third rigid panel having first and second opposed end edges, opposed side edges, and inner and outer major surfaces, disposed with its first end edge adjacent and generally parallel to the second end edge of the adjacent one of the first-mentioned two panels for angular movememnt relative thereto about an axis intermediate and generally parallel to the last-mentioned panel ends between an open position in which the inner surfaces of the third panel and the adjacent panel face generally in the same direction and an assembled position in which the last-mentioned inner surfaces are disposed in closely adjacent facing relation to each other; in this instance, the element also includes means for fastening the third panel and the adjacent panel together in the assembled position and the body of upholstery extends over the outer surface of said third panel, bridging the first end edge of the third panel and the second end edge of the adjacent panel. For example, the length of the adjacent panel may be substantially equal to the sum of the lengths of the third panel and the other of the first-mentioned two panels.

The furniture element of the invention affords important advantages especially with respect to ease of manufacture, in that the cover (to which the cushioning layer may be glued) and also the welt (when used) can be secured to the panels by a simple stapling or like operation when the panels are in open position. Attachment of support members to the element is also facilitated. In the process of making the element in accordance with the invention, after the cover, cushion and panels are initially positioned for assembly, the cover margin and the welt are secured to the panel inner surfaces and the panels are pivoted into the assembled position and secured together by the fastening means. The welt, if present, then serves to conceal the juncture between the panels along the side edges and second end edges thereof, while the cushion and cover curve smoothly over the first end edges thereof, and the welt ends are hidden in the fold of the cusion between the panels, thereby providing an upholstered element of aesthetically attractive appearance. Repair or reupholstering can readily be performed by reopening the element to expose the panel inner surfaces.

In a complete chair incorporating the upholstered elements of the invention, one of the elements constitutes the chair back and is disposed vertically with the panel first end edges oriented upwardly, while a second of the elements constitutes the seat and is disposed horizontally with the panel first end edges oriented forwardly. A support member mounted between the panels of the back element and extending downwardly between and below the second end edges of the panels interconnects with a support plate mounted on the downwardly facing outer surface of the seat element. Arm elements, oriented similarly to the back element but positioned along the chair sides, may be included and provided with support members extending downwardly from between their panels for connection to the seat element. The back support member may incorporate means (also disposed between the panels of the back element) for adjusting the vertical position of the back element.

Further features and advantages of the invention will be apparent from the detailed description hereinbelow set forth, together with the accompanying drawings.

BRIEF DESCRIPTION OF THE DRAWINGS

FIG. 4 is an enlarged cross-sectional side elevational view of the back element of FIG. 3;

FIG. 5 is a similarly enlarged cross-sectional side elevational view of the seat element of the chair of FIG. 1;

FIG. 6 is a further enlarged fragmentary detail cross-sectional view of a bottom edge portion of the FIG. 4 back element, illustrating the panel-fastening means of that element, taken along the line 6—6 of FIG. 2;

FIG. 7 is a similarly further enlarged fragmentary detail cross-sectional view of a side edge portion of the seat element of FIG. 5, taken as along the line 7—7 of FIG. 5;

FIG. 8 is a still further enlarged, exploded fragmentary perspective view of the panel-fastening means of FIG. 6;

FIG. 10 is a side elevational view of a chair generally similar to that of FIG. 1 but including, as a shoulder rest, an additional upholstered element embodying the invention;

FIG. 11 is a front elevational view of the chair of FIG. 10;

FIG. 12 is an enlarged, exploded perspective view of the back and shoulder rest of the chair of FIG. 10;

FIG. 13 is a further enlarged side sectional elevational view of the assembled back and shoulder rest of the FIG. 10 chair;

FIG. 14 is a side view in open position of another embodiment of the element of the invention, having three panels and adapted for use as a combined back and upper rest for a chair;

FIG. 15 is a perspective view of the element of FIG. 14 with the panels in assembled position;

FIG. 16 is a side view in open position of a further three-panel element embodying the invention, adapted for use as a seat;

FIG. 17 is a perspective view of the FIG. 16 element with the panels in assembled position, mounted on a base;

FIG. 18 is a schematic side elevational view of another form of element embodying the invention;

FIG. 19 is a schematic side elevational sectional view of a further modified embodiment of the invention, adapted for use as a combined chair seat and back; and FIG. 20 is an enlarged fragmentary detail view of a portion of the FIG. 19 structure.

DETAILED DESCRIPTION

Figure 3:
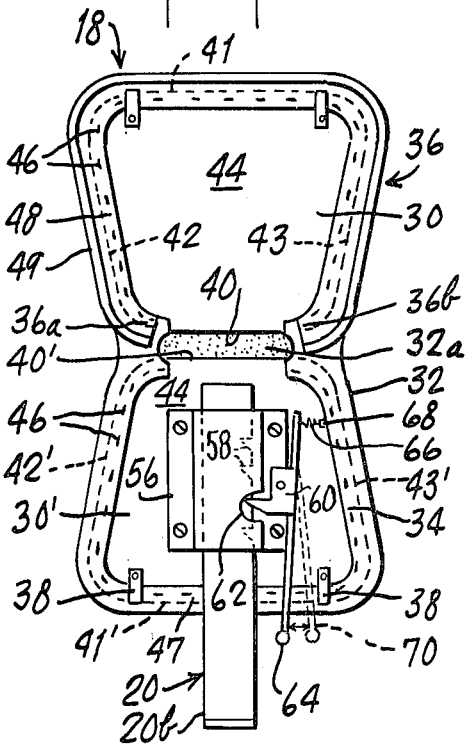
FIG. 3 is a front elevational view of the back element of the same chair, showing the panels in open position.

Referring first to FIGS. 1–9, there is shown an office chair 10 having a backrest 11, a seat 12, and two arms 14, interconnected and mounted on a base 16 which may be (for example) a conventional pedestal base and which is illustrated only fragmentarily because it does not in itself embody any feature of novelty of the present invention. The backrest comprises an upholstered back element 18 and a support member 20 extending downwardly and forwardly therefrom under the seat, while the seat comprises an upholstered seat element 22 and a support plate 24 located at its lower surface; each arm comprises an upholstered arm element 26 and a support member 28 extending downwardly and laterally therefrom under the seat. The back support member 20 is connected to the support plate 24, which engages the upper extremity of the base 16, and the arm support members 28 are secured to the lower surface of the seat element 22. Each of the upholstered elements 18, 22 and 26 constitutes an embodiment of the furniture element of the invention; although they differ from each other in dimensions and details of configuration in accordance with their differing respective functions as chair back, seat and arms, they are essentially identical in broad features of structure, and these broad features of all the elements may therefore be understood by detailed consideration of the back element 18, which is best seen in FIGS. 3 and 4.

The back element 18 comprises a pair of rigid panels 30 and 30′, a flexible cushion 32, a flexible web cover 34 and at least one welt member 36, together with fastening means 38. The two panels 30 and 30′, respectively located forwardly and rearwardly in the fully assembled element 18, are substantially identical to each other in shape and dimensions, i.e. shape and dimensions of the panel periphery, it being understood that the panels may vary considerably from each other in respects such as curvature. Panel 30 has first and second opposite end edges respectively designated 40 and 41, first and second opposite side edges respectively designated 42 and 43, and inner and outer opposed major surfaces respectively designated 44 and 45; similarly, panel 30′ has first and second opposite end edges respectively designated 40′ and 41′, first and second opposite side edges respectively designated 42′ and 43′, and inner and outer opposed major surfaces respectively designated 44′ and 45′. The panels are disposed, with their respective first end edges 40 and 40′ in closely adjacent generally parallel relation, so as to be angularly movable relative to each other about an axis intermediate and generally parallel to their first end edges, between an open position (FIG. 3) in which their respective inner surfaces 44 and 44′ face in the same general direction and an assembled position (FIG. 4) in which their inner surfaces are in facing closely adjacent relation and the end and side edges 40, 41, 42 and 43 of the panel 30 are in register with the corresponding end and side edges 40′, 41′, 42′ and 43′ of the panel 30′.

The cushion 32 extends over the outer surfaces 45 and 45′ of the two panels, bridging their first end edges 40 and 40′. The cover 34, disposed outwardly of the cushion in covering relation thereto, has a margin 47 which extends around the edges of the cushion and around the side edges and second end edges of the two panels, so that portions of the cover margin overlie and are secured to the inner surface 44 of the panel 30 along its side edges and second end edge, while other portions of the cover margin overlie and are secured to the inner surface 44′ of the panel 30′ along the side edges and second end edge thereof. Between the two panels, the cover margin overlies both sides of the inwardly facing surface of the portion 32*a* of cushion 32 bridging the panel first end edges.

The welt member 36 extends entirely around the side edges and second end edges of the panel 30. It has a longitudinal flange portion 48 overlying and secured to the inner surface 44 of panel 30 along the side edges 42, 43 and second end edge 41 thereof, and a longitudinal bead portion 49 projecting laterally beyond the last-mentioned panel edges so as to be visible when the panels are in the assembled position. Further, the welt member has opposite ends 36*a* and 36*b* curving toward each other along the first end edge 40 of the panel 30 from opposite sides thereof so as to be concealed when the panels are in the assembled position, the bead portion 49 projecting laterally beyond the panel edge 40 at the ends of the welt member so as to be received within the cushion portion 32*a* bridging the first end edges of the panels. It will be understood that while the welt member is shown as mounted on the panel 30, merely by way of example, the welt member could alternatively be mounted on the panel 30′ instead, i.e. in the same relation to the panel surfaces and edges as described above with reference to the panel 30, it being immaterial which one of the panels has the welt member mounted on it; indeed, a welt member could be included on each of the panels if desired, e.g., to form a double welt in the upholstered element.

The fastening means 38 serves to hold the two panels together in the assembled position and is preferably adapted to fasten the panels detachably, so that they can be separated and returned to the open position if necessary for repair or reupholstering.

More particularly, each of the panels 30 and 30', in the embodiment of FIGS. 3 and 4, is a unitary piece of material, such as plywood, having the requisite rigidity and strength to sustain the shape of the element 18 and to bear the load of a seated person's back leaning against the backrest; preferably the material of which the panels are formed is of such a character that the cover margin and welt member can be secured to the panels by staples or like penetrating fasteners. One example of a suitable material for the panels is quarter-inch-thick plywood. In the specific illustrated embodiment, the panels 30 and 30' are of generally trapezoidal configuration with rounded corners, the first end edges 40 and 40' of the panels being the small ends of the trapezoids. To provide a back element 18 that is forwardly concave about a generally vertical axis, to conform to the back of a person sitting in the chair, each of the panels may be appropriately curved about the generally vertical axis so that the forward surface of each panel (referring to the surface orientation of the panels in the assembled position) is concave and the rearward surface of each panel is convex; thus, in the embodiment of FIGS. 3 and 4, the outer surface 45 of the forward panel 30 is concave and the inner surface 44 of that panel is convex, while the inner surface 44' of panel 30' is concave and its outer surface 45' is convex. When the panels are in the assembled position, then, the convex inner surface of the panel 30 faces the concave inner surface of the panel 30' with closely conforming curvature and consequent substantially uniform spacing between the panel inner surfaces throughout their extents.

The cushion 32 may be constituted, for example, of a resiliently compressible material such as foam rubber or foam urethane, and may be a unitary body of such material preshaped to fit over the entire outer surfaces of both panels 30 and 30' and to bridge their first end edges. The preshaped cushion may differ in thickness at different locations around the element 18; for instance, the portion of the cushion extending over the outer surface of the rearward panel 30' may be substantially thinner than the portion of the cushion which extends over the outer surface of the forward panel 30 and engages the sitter's back. This forward portion of the cushion may be additionally varied in thickness to further contour the chair back, e.g. reaching a maximum thickness in the middle portion of the element 18, and the cushion portion 32*a* bridging the first end edges of the panels may be locally increased in thickness to provide an enlargement at or just rearwardly of the top of the element 18. The specific configuration of the cushion, and the relative thicknesses of its different portions, may be selected in accordance with considerations of comfort and design and may vary widely in different elements embodying the invention.

As will be apparent from FIG. 3, when the element 18 is in the open position, the cushion 32 has a generally hourglass-shaped periphery. Its inner surface (i.e. the surface toward the panels 30 and 31) may have shallow recesses respectively dimensioned and positioned to receive the two panels so that when the panels are placed on the cushion, their edges are completely surrounded by material of the cushions and their inner surfaces are substantially flush with the surrounding portions of the cushion inner surface.

The cover 34 may be a one-piece flexible web constituted of a stretchable fabric or of other flexible sheet material, such as leather or vinyl, suitable for use on upholstered chairs. This cover extends over the entire exposed surface of the cushion 32, in outwardly covering relation thereto, and its continuous margin 47 extends around the edges of the cushion and of the two panels into contact with the inner surface of both panels, i.e. along the side edges and second end edges thereof, being secured to the panels at the panel inner surfaces by means such as staples 46 spaced along the margin 47. That is to say, first portions of the cover margin are stapled to the inner surface 44 of the panel 30 along the side edges and second end edge thereof, while other portions of the margin 47 are similarly stapled to the inner surface of the panel 30' along the corresponding edges.

The welt member 36 is a unitary flexible member having its longitudinal flange portion 48 disposed in overlying relation to the portions of the cover margin which overlie the panel inner surface to which the welt is secured. Conveniently, the welt may be secured to the panel inner surface by staples 46'. The welt member may be any of a variety of conventional welt constructions, for example stitched fabric, leather, or other material; one very satisfactory form of welt is a one-piece vinyl extrusion. In place of the described flexible welt member, another type of trim member may be used, such as a rigid aluminum or other metal trim strip, for example having essentially the same shape and disposition as the welt 36, secured to the panel e.g. by screws. Other types of trim member may also be used, or the trim member may be omitted, especially if the cushion (as shown) laterally surrounds the panel edges and is sufficiently full to leave no gap along the juncture between panels when the panels are in the assembled position.

As best seen in FIGS. 6 and 8, the fastening means 38 may include a pair of first clips 50 fixedly secured as by screws to the inner surface 44 of panel 30 adjacent the panel second end edge 41, on opposite sides of the panel, and a pair of second clips 52 similarly mounted on the inner surface 44' of the panel 30' adjacent the second end edge 41' of that panel, the clips 50 and 52 being respectively shaped and disposed to be in register when the panels are in the assembled position. Each clip 50 is then fastened to its associated clip 52 by a threaded member such as a screw 54, thereby securing the panels together in the assembled position. The clips 50 and 52 are further so arranged that the heads of the screws holding them together are externally accessible, thereby not only enabling the screws to be inserted with the panels in assembled position but also permitting the screws readily to be removed for releasing the panels from the assembled position when it is desired to open them for repair or reupholstering. Alternatively, the positions of the clips can be reversed; i.e. clip 50 can be mounted on panel 30' and clip 52 on panel 30.

As will now be appreciated, the structure and arrangement of the unit 18 greatly facilitates its manufacture, as compared with conventional upholstered furniture elements such as have heretofore been used for office chairs or the like. With the cover 34, cushion 32 (glued to the outer surfaces of the panels), and panels 30 and 30' in the FIG. 3 (open) position, initially disposed for assembly, the margin 47 of the cover is stretched around the panel edges and stapled to the panel inner surfaces. The welt, positioned as shown in FIG. 3, is then stapled to the inner surface of one of the panels over the cover margin. Installation of the cover and welt is thus completed in a succession of very simple operations. After the welt has been installed, one of the panels is pivoted relative to the other about the aforementioned axis intermediate their first end edges, to bring the panels into the assembled position, at which point the clips 50 and 52 are interconnected by the screws 54 to detachably fasten the panels together. In the thus-assembled element, the bead portion of the welt conceals the juncture of the two panels along the side edges and second end edges thereof, the ends of the welt being concealed within the fold of the cushion, and the cushion and cover extend smoothly over the first end edges of the panels, providing an upholstered furniture element having a finished and aesthetically pleasing appearance. Since the cover margin 47 and the flange portion 48 of the welt member are both stapled to inner surfaces of the panel, the stapled cover margin and welt flange are entirely concealed when the panels are in the assembled position.

As stated, the backrest 11 also includes a support member 20 which may be an elongated, substantially rigid strip of steel having its upper portion 20*a* disposed between the panels 30 and 30' in the assembled element 18, and having a lower portion 20*b* which extends downwardly between and below the second end edges of the two panels and then curves forwardly for engagement with the support plate 24 beneath the seat element 22. The upper portion 20*a* of the support member may be mounted on the inner surface of one of the two panels of the element 18, for example the panel 30', as seen in FIG. 3. In the form shown, this mounting means includes a plate 56 of steel or the like, bolted to the panel 30' and defining a generally vertical open-ended channel for slidably receiving the upper portion 20*a* of the support member.

As a further feature of advantage and convenience, the mounting of the support member within the element 18 may be such as to permit adjustment of the vertical position of the element 18 relative to the support member. To this end, a plurality of ratchet teeth 58 may be formed in one side edge of the support member upper portion, and a pawl 60 may be pivotally mounted on the inner surface of the panel 30' for engagement with the ratchet teeth through an opening provided by a cutaway portion 62 of the plate 66. The pawl 60 may be connected to a handle 64 extending between and below the second end edges of the panels 30 and 30' so as to be accessible for manual operation when the panels are in the assembled position. Means such as a spring 66 under tension, acting between an extension of the handle 64 and a small lug 68 secured to the inner surface of the panel 30', biases the pawl into engagement with the ratchet teeth. Manual movement of the handle 64 to the position indicated in broken lines at 70 releases the ratchet teeth from the pawl, permitting vertical movement of the element 18 to a new position relative to the support member 20, where the spring 66 brings the pawl 60 into engagement with another of the ratchet teeth 58 for holding the element 18 in the new position. It will be understood that the spring 66 is exemplary of means for resiliently biasing the pawl into engagement with the ratchet teeth.

The seat element 22 is essentially similar to the back element 18 in structure and arrangement, although its specific configuration and such features as the thickness of the cushion at various points are selected with reference to its function as a seat, and the arrangement of the cushion and cover on the downwardly facing panel outer surface are designed to accommodate mounting of the support plate 24 on that surface, as hereinafter explained.

Specifically, the seat element 22 comprises a pair of rigid panels (e.g. of quarter-inch plywood), viz. upper and lower panels respectively designated 130 and 130', substantially identical to each other in shape and dimensions and having the same disposition relative to each other as the panels 30 and 30' of the element 18. A cushion 132 extends over the entire outer surface of the panel 130 and partially over the outer surface of the panel 130', bridging the first end edges 144 and 144' of the panels, while a flexible web cover 134 extends over the cushion in outwardly covering relation thereto and has its margins secured (e.g. stapled) to the panel inner surfaces along the side and second end edges of the panels. A welt member 136, which may be essentially identical to the welt member 36 of the element 18, is secured to one of the panels 130 or 130' in the same arrangement as shown for welt 36 in FIG. 3. As will be apparent from FIG. 7, when the panels 130 and 130' are in assembled position they are spaced apart only by the two thicknesses of the cover margin and the thickness of the flange portion of the welt member 136 that are secured to their inner surfaces and thus interposed between them.

In the seat element 22, however, the cushion 132 does not extend over the entire downwardly facing outer surface of the lower panel 130' but only over the peripheral portion of that surface; i.e. the cushion has an opening in register with a central portion of the outer surface of panel 130', and the cover 134 is in direct contact with that central portion of the panel outer surface. The support plate 24, which may be a rigid structure of steel or the like, is as shown in FIG. 5 disposed in engagement with the cover at the uncushioned central portion of the outer surface of panel 130', and is secured to the element 22 by means of threaded members such as bolts which (as best seen in FIG. 7) extend through both panels 130' and 130 and are received in T-nuts 156 seated in the outer surface of the upper panel 130. These bolts 154 not only mount the support plate 24 on the element 22, but also constitute the means for securing the two panels 130 and 130' of the latter element together in the assembled position and are externally accessible so that they can readily be inserted and removed; removal of the bolts releases the panels so that the seat element can be opened, in like manner as the element 18, for repair or reupholstering if necessary.

In the back element 18, as shown in FIGS. 3 and 4, the cushion 32 and cover 34 in effect constitute a hinge for pivotal movement of the panels 30 and 30' between their open and assembled positions. If desired, supplemental hinge members, such as flexible (e.g. fabric) straps extending between and stapled to the two panels at spaced locations along the first end edges thereof, may be provided to afford enhanced support. One such flexible fabric hinge, designated 160, is shown in FIG. 5 as included in the seat element 22, and is further illustrated in the fragmentary perspective view of FIG. 9.

The arm elements 26, again, are essentially identical in structure to the back element 18, except for differences in shape. Thus, each of them includes a pair of panels (not shown) surrounded by a cushion (not shown) and a flexible web cover, together with a welt member 162, and is provided with a substantially rigid steel strip support member 28 mounted at its upper end between the panels and extending downwardly therefrom between and below the second end edges of the arm element panels and then laterally under the chair seat, where the lower extremities of these support elements 28 are secured to or interconnected with the support plate 24.

Figure 1:
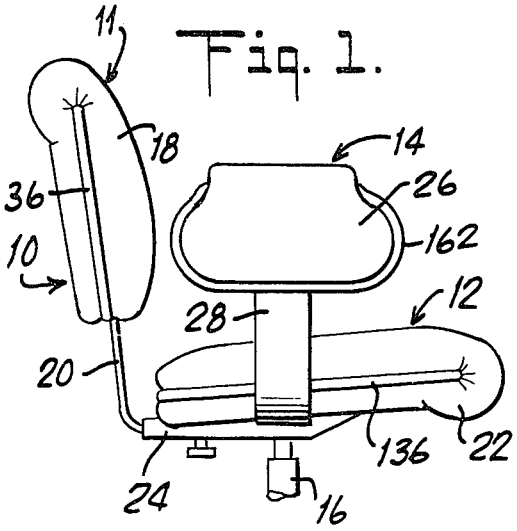
FIG. 1 is a side elevational view of an office chair which incorporates upholstered furniture elements (seat, back and arms) embodying the present invention in a particular form.
Figure 2:
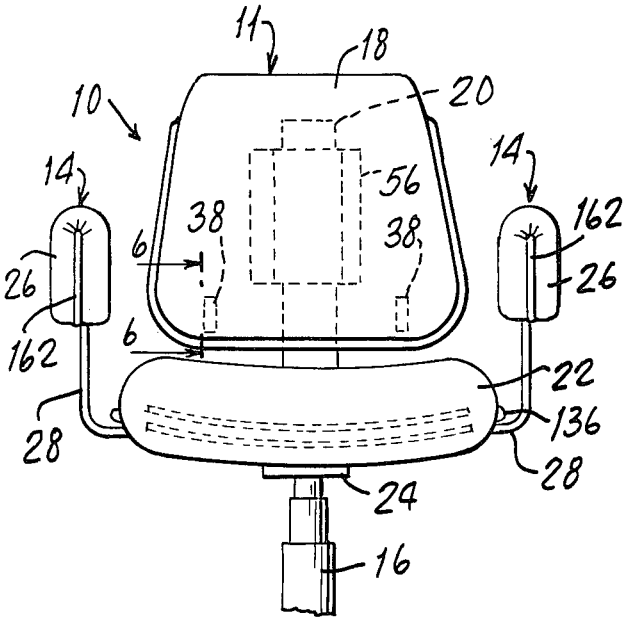
FIG. 2 is a front elevational view of the chair of FIG. 1.
Figure 9:
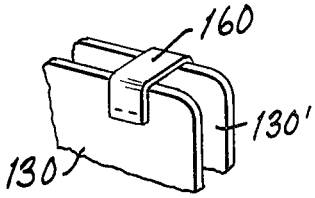
FIG. 9 is a fragmentary perspective view of a hinge between the first end edges of the panels of the seat element of FIG. 5.

In the complete chair shown in FIGS. 1 and 2, the back element 18 is disposed vertically with the first end edges of its panels oriented upwardly. The arm elements 26 are likewise disposed vertically, but along the sides of the chair, again with the first end edges of their panels (not shown) oriented upwardly; and the seat element 22 is disposed horizontally, with the first end edges of its panels oriented forwardly. This specific arrangement of the elements is advantageous both in facilitating the provision of back and arm support members mounted between the panels of the respective back and arm elements and extending downwardly therefrom between the second end edges of those panels, and also in presenting the fully cushioned edges of the elements (i.e. those edges where the cushion of the element bridges the first end edges of the panels) at the locations of contact with the body of a person sitting in the chair, viz. the tops of the arms and back and the front of the seat.

As shown in FIGS. 10–13, the chair may also have a shoulder rest, headrest, or upper backrest (herein generically termed an "upper rest") 162 comprising an additional upholstered furniture element 164 embodying the invention and, again, generally similar in construction to the back element 18 described above. The chair of FIGS. 10–13 is essentially the same as that of FIGS. 1–9 (like parts being designated by like reference numerals), except that the arms are omitted for simplicity of illustration, the proportions of the back element 18 are somewhat altered for reasons of design, and the top of the back element 18 is further modified to accommodate the upper rest, as hereinafter further explained.

The upper rest element 164 includes a pair of rigid panels 166, 166' each having a first end edge (167, 167'), a second end edge (168, 168'), side edges, and inner and outer major surfaces; a cushion 170 extending over the outer surfaces of both panels and bridging their first end edges; a flexible web cover 172 extending over the cushion with its margin secured to the inner surfaces of the panels along the side edges and second end edges thereof; at least one welt member (or other trim member) 174, extending around the edges of the inner surface of one of the panels; and fastening means 176 (which may be constituted of clips and screws similar to the clips 50 and 52 and screws 54 of the back element 18, as described above), all essentially identical in arrangement to the corresponding parts of the back element 18. With its panels secured together in the assembled position as shown, the upper rest element 164 is disposed generally vertically, immediately above the back element 18, its panels having their first end edges oriented upwardly.

A pair of generally vertically extending rigid support members 178 (e.g. steel bars) are disposed with their upper portions located between the panels 166, 166' of the upper rest element 164 and bolted to the panel 166'. These members 178 extend, parallel to each other (and respectively adjacent opposite sides of the upper rest element) between and below the second end edges of the upper rest element panels; their lower portions, inserted between the first end edges 40 and 40' of the panels of the back element 18 (on opposite sides, respectively, of the panel-bridging portion **32*a* of the back element cushion), extend downwardly between the back element panels 30 and 30', and are bolted to the panel 30' to secure the upper rest to the back element. The portion 32*a* of the back element 18 is somewhat cut away on both sides, as shown in FIG. 12, to accommodate the support members 178. As will be appreciated, the members 178 are bolted to the panel 166' of the element 164 before the panels of that element are moved to the assembled position, and similarly, these members are bolted to the panel 30'** while the back element panels are in open position.

FIGS. 14 and 15 illustrate another embodiment of the invention, viz. an upholstered furniture element 200 having three rigid panels respectively designated 202, 204 and 206 and adapted, when assembled, to constitute a combined back and upper rest for a chair. In this particular embodiment, the three panels are at least substantially identical to each other in width (dimension between their opposed side edges) but differ from each other in length (dimension between their opposed end edges), and in their open position are disposed end-to-end. More particularly, the first panel 202 (at one end of the element 200, in the open position) has a first end edge 208, a second end edge 209, opposed side edges, and inner and outer major surfaces (210 and 211, respectively); the second panel 204 (in the middle of the element 200, in open position) likewise has first and second end edges respectively designated 214 and 215, opposed side edges, and inner and outer major surfaces respectively designated 216 and 217, while the third panel 206 (at the other end of the element) has first and second end edges respectively designated 218 and 219, opposed side edges, and inner and outer major surfaces respectively designated 220 and 221.

Panels 202 and 204 are disposed, with their first end edges 208, 214 in adjacent, generally parallel relation, for relative angular movement about an axis intermediate and generally parallel to their first end edges between an open position in which their inner surfaces face generally in the same direction and an assembled position in which their inner surfaces are in closely adjacent facing relation to each other. The third panel 206 is disposed with its first end edge 218 in adjacent, generally parallel relation to the second end edge 215 of the middle panel 204 (i.e. at the end of panel 204 opposite from panel 202) for angular movement, relative to panel 204, about an axis intermediate and generally parallel to the edges 215, 218 between an open position in which the inner surfaces of panels 204 and 206 face generally in the same direction and an assembled position in which their inner surfaces are in closely adjacent facing relation to each other. The open position of the panels is shown in solid lines in FIG. 14, and the assembled position is indicated by broken lines in FIG. 14.

A body of upholstery 224, such as a cushion and a flexible web cover overlying the cushion in outwardly covering relation thereto, extends over the outer surfaces of all three panels 202, 204 and 206, bridging the panel edges 208, 214 and 215, 218; the margin of the cover extends around the side edges of all the panels and around the second end edges of panels 202 and 206 and is secured in overlying relation to the inner surfaces of the three panels. Welts or other trim members 226 (FIG. 15) may be provided, for example around the side and second end edges of the two panels 202 and 206, secured to the panel inner surfaces and having ends curving toward each other along the panel first end edges so as to be concealed when the panels are in the assembled position.

When the panels 202 and 206 are in the assembled position (relative to panel 204), represented by broken lines in FIG. 14, they completely overlap the panel 204 but do not overlap each other; i.e. the opposite ends of the upholstery body 224, respectively located at the second end edges of the panels 202 and 206, are in contact with each other. To provide this dimensional relationship, each of the panels 202 and 206 is substantially shorter (from end edge to end edge) than the panel 204. In the embodiment of FIG. 14, the sum of the lengths of panels 202 and 206 is substantially equal to the length of panel 204, it being understood that the combined length of panels 202 and 206 is actually smaller than the length of panel 204 by the amount necessary to accommodate the end thicknesses of the upholstery body which abut each other.

As stated, the element 200 of FIGS. 14 and 15, with the panels in assembled position (and fastened together by suitable fastening means, not shown), constitutes a combined back and upper rest for a chair. The panel 206, which determines the length of the upper rest portion, is in this embodiment made considerably shorter than the panel 202 which determines the length of the back portion. A rigid support member 20', generally similar to the support member 20 of the chair of FIGS. 1–9, may be mounted between the panels 202, 204, extending downwardly and forwardly therefrom for attachment to other components of the chair. Since the upholstery body 224 extends around the bridges the first end edges of the panels 202, 204, which end edges are oriented downwardly when the assembled element 202 is positioned for use as a chair back, an opening 228 (FIG. 15) is formed in the panel-bridging portion of the body 224 to accommodate the support member 20', the member 20' being inserted through this aperture 228 and secured as by bolts (not shown) to the panel 204 before the panel 202 is moved into the assembled position.

Another three-panel upholstered furniture element 230 embodying the invention is shown in FIGS. 16 and 17. This element 230 includes a first panel 232, second panel 234, and third panel 236, generally similar to the panels 202, 204 and 206 of the element 200 and having the same relative disposition as those panels, with a body of upholstery 240 extending over the outer surfaces of the three panels 232, 234 and 236 and bridging their adjacent end edges. Welt members 242 may be included in the element, e.g. mounted on the inner surfaces of panels 232 and 236 around the side and second end edges thereof.

In the FIG. 16 embodiment, the two panels 232 and 236 respectively located at opposite ends of the element when in open position (solid lines, FIG. 16) have a combined length that is again substantially equal to the length of the central panel 234 (less than thicknesses of the abutting ends of the upholstered body) so that when the panels 232 and 236 are in the assembled position represented by broken lines in FIG. 16, they fully overlap the panel 234 and their upholstered ends but each other. Panels 232 and 236, however, are equal to each other in length so that they meet at the center line of panel 234.

The element of FIG. 16 is adapted for use as a stool, for example, being inverted after the panels are moved to assembled position and mounted on a base 244. The base engages the lower surfaces of element 230 and is secured to the element, for example, by means of screws of bolts (not shown) which also serve as the means for fastening the panels of the element together in their assembled position.

A further modified embodiment of the invention is shown in FIG. 18. The FIG. 18 structure includes a three-panel element 246 embodying the invention, and generally similar in construction to the element 230 of FIG. 16 except that the two end panels 248 and 250 have a combined length considerably shorter than the length of the central panel 252. When the three panels 248, 250 and 252, with their surrounding upholstery body 254, are disposed in the assembled position shown in FIG. 18, there is a gap between the facing ends of the panels 248 and 250, which may be filled by a panel-reinforced upholstered cushion member 256 compatible in design with the element 246. The assembled element 246 and the cushion member 256 cooperatively provide a three-section upholstered bench, which may be mounted on a base 258 secured thereto by bolts 260 which also serve as means for fastening the panels of the element 246 in assembled position to each other and to the reinforcing panel of the cushion 256.

FIGS. 19 and 20 illustrate a further modified embodiment of the invention comprising two upholstered furniture elements 264 and 266 each having the general features of structure and arrangement of the above-described back element 18. Each of the elements 264 and 266 is a two-panel element. In the FIG. 19 structure, the element 264 is disposed to serve as the back of a chair, and the element 266 is disposed to serve as the chair seat. The second end edges of the panels of element 264 face the second end edges of the panels of element 266. The rearwardly disposed panel 268 of the back element 264 is rigidly secured to the downwardly disposed panel 270 of the seat element 266 by means of brackets 272 which extend between the second end edges of the panels of both elements and are fastened to the aforementioned panels 268 and 270 by bolts 274 cooperating with nuts 276 (FIG. 20). These brackets are attached while the panels of the two elements 264 and 266 are in the open position shown in broken lines in FIG. 19, and the panels of the two elements are thereafter moved to and fastened (by suitable means, not shown) in the assembled position represented in solid lines in FIG. 19.

As in the case of the other embodiments described, the elements 264 and 266 of the FIG. 19 chair may be provided with welt members or other trim members (not shown). Aslo, the chair of FIG. 19 could be constructed as a single three-piece element in accordance with the invention, with a continuous body of upholstery bridging the juncture between panels 270 and 268; in such case, those panels with their interconnecting brackets effectively constitute a single central panel for the element.

It is to be understood that the invention is not limited to the features and embodiments hereinabove specifically set forth but may be carried out in other ways without departure from its spirit.

I claim:

1. An upholstered furniture element comprising at least two panels each having edges including a first end edge and inner and outer major surfaces, said two panels being disposed in assembled position with their first end edges in closely adjacent, generally parallel relation for angular movement relative to each other about an axis intermediate and generally parallel to their first end edges between an open position in which their inner surfaces face generally in the same direction and said assembled position in which their inner surfaces are in facing relation to each other; (b) a flexible body of upholstery extending over the outer surfaces of said two panels and bridging their first end edges, said body having a web margin with portions respectively extending around edges of said two panels and secured in overlying relation to the inner surfaces of said two panels such that when said two panels are in assembled position the aforesaid margin portions are concealed; and (c) means for fastening said two panels together in said assembled position, wherein at least one of said two panels has a side edge, said element further including at least one trim member, extending at least along said inner edge of said one panel and secured to the inner surface of said one panel and projecting laterally beyond said side edge so as to be visible, and to conceal the juncture between said two panels, when said two panels are in said assembled position.

2. An element as defined in claim 1, wherein said trim member has at least one end portion, extending from said one side edge along the first end edge of said one panel for a sufficient distance so as to be concealed when said two panels are in said assembled position.

3. An element as defined in claim 2, wherein said one panel has opposite side edges and a second end edge opposed to the first end edge of said one panel; wherein said web margin includes portions respectively extending around each of the side edges and second end edge of said one panel and secured in overlying relation to the inner surface of said one panel; and wherein said trim member extends continuously around both side edges and the second end edge of said one panel and has opposed end portions curving toward each other along the first end edge of said one panel from opposite sides thereof.

4. An element as defined in claim 3, wherein said trim member is a flexible welt.

5. An element as defined in claim 1, wherein said fastening means comprises means for detachably fastening said two panels together in said assembled position.

6. An element as defined in claim 5, wherein said fastening means comprises at least one threaded member for fastening the two panels together as aforesaid, said threaded member being disposed to be externally accessible for insertion or removal when the two panels are in the assembled position.

7. An element as defined in claim 1, wherein said two panels both have opposed side edges and are substantially equal to each other in width between the side edges; and wherein the side edges of the two panels are in register with each other when the panels are in the assembled position.

8. An element as defined in claim 7, wherein each of said two panels has a second end edge opposed to the first end edge thereof, said two panels being substantially equal to each other in length between the end edges.

9. An element as defined in claim 7, wherein each of said two panels has a second end edge opposed to the first end edge thereof, and further including a third rigid panel having first and second opposed end edges, opposed side edges, and inner and outer major surfaces, disposed with its first end edge adjacent and generally parallel to the second end edge of one of said two panels for angular movement relative thereto about an axis intermediate and generally parallel to the last-mentioned panel ends between an open position in which the inner surfaces of said one panel and said third panel face generally in the same direction and an assembled position in which the last-mentioned inner surfaces are disposed in closely adjacent facing relation to each other; said element also including means for fastening said third panel and said one panel together in the last-mentioned assembled position; said body of upholstery extending over the outer surface of said third panel and bridging the second end edge of said one panel and the first end edge of said third panel.

10. An element as defined in claim 9, wherein the length of said one panel between the end edges thereof is substantially equal to the sum of the lengths of said third panel and the other of said two panels.

11. An element as defined in claim 1, wherein said body of upholstery comprises a flexible cushion overlying the outer surfaces of said two panels and a flexible web cover overlying said cushion in outwardly covering relation thereto and having a margin constituting the web margin of said body.

12. An upholstered furniture element comprising:

(a) a pair of rigid panels of substantially identical shape and dimensions each having first and second opposite end edges, first and second opposite side edges, and inner and outer major surfaces, said panels being disposed in assembled position, with their respective first end edges in closely adjacent generally parallel relation, so as to be angularly movable relative to each other, about an axis intermediate and generally parallel to the first end edges of the panels, between an open position in which their inner surfaces face in the same direction and said assembled position in which their inner surfaces are in facing closely adjacent relation and the end and side edges of one of the panels are in register with the corresponding end and side edges of the other panel;

(b) a flexible cushion extending over the outer surface of one of the panels and at least part of the outer surface of the other panel and bridging the first end edges of the two panels;

(c) a flexible web cover disposed outwardly of said cushion in covering relation thereto, and having a margin with portions respectively extending around the side edges and second end edges of the panels and secured to the inner surfaces of the panels adjacent the side and second end edges thereof;

(d) a welt member extending entirely around the side edges and second end edges of one of the panels, said welt member having a longitudinal flange portion overlying and secured to the inner surface of the last-mentioned panel along the side edges and second end edge thereof, and a longitudinal bead portion projecting laterally beyond the last-mentioned panel edges so as to be visible when the panels are in said assembled position, said welt member further having opposite ends curving toward each other along the first end edge of the last-mentioned panel from opposite sides thereof so as to be concealed when said panels are in said assembled position, said bead portion projecting laterally beyond said last-mentioned first end edge at the ends of the welt member so as to be received within the portion of the cushion bridging the first end portions of the panels; and (e) means for fastening said panels together in said assembled position.

13. A furniture element as defined in claim 12, further including means for hingedly connecting said panels together along said first end edges thereof.

14. A furniture element as defined in claim 13, wherein said connecting means comprises a flexible web member secured to said panels adjacent the first end edges thereof.

15. A furniture element as defined in claim 14, wherein said connecting means comprises a plurality of flexible straps disposed in spaced relation to each other along the first end edges of said panels and each secured to the two panels adjacent said first end edges thereof.

16. A furniture element as defined in claim 12, wherein said fastening means comprises means for detachably fastening said panels together in said assembled position.

17. A furniture element as defined in claim 16, wherein said fastening means includes threaded means for interconnecting said panels, said threaded means being disposed to be externally accessible when said panels are in said assembled position thereby to permit insertion and removal of the threaded means for securing the panels in and releasing the panels from said assembled position.

18. A furniture element as defined in claim 17, wherein said fastening means further comprises first and second clips, respectively secured to the two panels adjacent the second end edges thereof, and shaped and disposed to be in register, and to be interconnected by said threaded means, when said panels are in said assembled position.

19. A furniture element as defined in claim 12, wherein said welt member is a unitary flexible strip.

20. A furniture element as defined in claim 19, wherein said cover is a one-piece web having a continuous margin whereof a first portion overlies the inner surface of one of the panels and is stapled thereto, and a second portion overlies the inner surface of the other panel, said flange portion of said welt member overlying said second cover margin portion along the inner surface of said other panel and being stapled with said second cover margin portion to said last-mentioned panel inner surface.

21. A furniture element as defined in claim 12, for use as an upright element of a chair or the like with the first end edges of the panels oriented upwardly, further including a substantially rigid, vertically elongated support member for securing said furniture element to other elements of the chair, said support member having an upper portion disposed between the inner surfaces of said panels, and a lower portion projecting downwardly between and below the second end edges of the panels, when the panels are in said assembled position; and means for mounting said support member on the inner surface of one of said panels.

22. A furniture element as defined in claim 21, wherein said support member upper portion has a side edge with a plurality of vertically spaced ratchet teeth formed therein, and wherein said support member mounting means comprises: (i) a bracket secured to the inner surface of one of said panels for vertically slidably receiving said support member; (ii) a pawl pivotally mounted on said inner surface of said last-mentioned panel for engaging said ratchet teeth; (iii) means for resiliently biasing said pawl into engagement with a ratchet tooth of said support member; and (iv) a handle for said pawl, extending between and below the second end edges of said panels, thereby to permit adjustment of the relative vertical positions of the panels and support member by vertically sliding the panels relative to the support member and engaging the pawl with different ones of the ratchet teeth.

23. A furniture element as defined in claim 12, for use as a seat of a chair or the like, wherein the outer surface of one of said panels faces upwardly and the outer surface of the other panel faces downwardly with the panels in said assembled position; wherein said cushion extends only around the periphery of the outer surface of said other panel; and further including a rigid support plate overlying the central portion of said other panel outer surface for attaching other elements of the chair thereto.

24. A furniture element as defined in claim 23, wherein said fastening means comprises a plurality of threaded members extending inwardly through the support plate and said other panel into said one panel, said threaded members being externally accessible when the panels are in said assembled position, thereby to permit insertion and removal of the threaded members for securing the panels in and releasing the panels from said assembled position.

25. A furniture element as defined in claim 23, wherein said cover has a portion in contact with said central portion of said other panel outer surface.

26. A chair comprising a plurality of furniture elements as defined in claim 12, a first one of said furniture elements constituting the back of the chair and being disposed generally vertically with the panels in assembled position having their first end edges oriented upwardly, and a second one of said furniture elements constituting the seat of the chair and being disposed generally horizontally with its panels in assembled position having their first end edges oriented forwardly; said chair further including a base, a substantially rigid support member secured between the panels of said first furniture element and extending downwardly therefrom, a rigid support plate disposed below and secured to said second furniture element, and means interconnecting said base, said support member, and said support plate.

27. A chair as defined in claim 26, further including at least a third one of said furniture elements constituting an arm of the chair and disposed generally vertically with its panels in assembled position having their first end edges oriented upwardly, and a further substantially rigid support member secured between the panels of said third furniture element and extending downwardly therefrom and interconnected with said seat.

28. A chair as defined in claim 26, further including an upper rest comprising at least a third one of said furniture elements, disposed generally vertically, immediately above said first element, with the panels of the third element in assembled position having their first end edges oriented upwardly, said upper rest including a pair of rigid support members each having an upper end portion secured to the inner surface of one of the panels of said third element and a lower end portion secured to the inner surface of one of the panels of said first element, said last-mentioned rigid support members extending downwardly between the second end edges of the third element panels and between the first end edges of the first element panels on opposite sides, respectively, of the first element cushion and cover.

29. A method of assembling a furniture element as defined in claim 12, comprising (a) disposing said cushion in overlying relation to said cover;

(b) disposing said panels in open position in overlying relation to said cushion with the panel inner surfaces facing upwardly;

(c) securing, to the inner surface of one of the panels, the portion of the cover member margin adjacent the side edges and second end edge of said one panel;

(d) securing, to the inner surface of the other of the panels, the welt member and the portion of the cover member margin adjacent the side edges and second end edge of said other panel;

(e) pivotally moving the panels relative to each other about said axis from the open position to the assembled position; and (f) fastening the panels together in the assembled position with the fastening means.

30. An upholstered furniture element comprising (a) an upholstered body having first and second opposed major surfaces, opposite side edges, and opposite end edges, said body being foldable, about at least one axis intersecting said side edges, into at least two overlapping portions with the first surfaces of said two portions disposed in closely adjacent facing relation to each other, and said body including a flexible upholstery cover at the second surface thereof extending continuously from one of said portions to the other across said one axis;

(b) at least one welt member, extending continuously around the side edges and end edge of one of said portions and secured to the first surface of said one portion, adjacent said side edges and said end edge thereof, said welt member projecting laterally beyond the last-mentioned side and end edges so as to be visible when the body is folded into at least two overlapping portions as aforesaid, and having opposite ends curving toward each other at said one axis from opposite sides of said one portion so as to be concealed when the body is folded as aforesaid; and (c) means for fastening the two overlapping portions together when the body is folded as aforesaid.

* * * * *